United States Patent [19]

Gilb

[11] 4,069,635

[45] Jan. 24, 1978

[54] TRUSS STRUCTURE WITH CLEVIS ASSEMBLY JOINTS

[75] Inventor: Tyrell T. Gilb, Berkeley, Calif.

[73] Assignee: Simpson Manufacturing Co., Inc., San Leandro, Calif.

[21] Appl. No.: 758,061

[22] Filed: Jan. 10, 1977

[51] Int. Cl.[2] ..... E04C 3/292

[52] U.S. Cl. ..... 52/693; 52/DIG. 6

[58] Field of Search ..... 52/693, 694, 692, 690, 52/696, 639, 641, DIG. 6; 85/13

[56] References Cited

U.S. PATENT DOCUMENTS

| | | | |
|---|---|---|---|
| 3,137,899 | 6/1964 | Troutner | 52/693 |
| 3,268,251 | 8/1966 | Troutner | 52/693 |
| 3,535,845 | 10/1970 | Troutner | 52/639 |
| 3,537,224 | 11/1970 | Troutner | 52/693 |
| 3,570,204 | 3/1971 | Birkemier | 52/693 X |
| 3,823,522 | 7/1974 | Jureit et al. | 52/641 |
| 3,857,218 | 12/1974 | Gilb | 52/694 |
| 3,946,532 | 3/1976 | Gilb | 52/692 |
| 3,961,455 | 6/1976 | Peters | 52/693 |
| 3,985,459 | 10/1976 | Gilb | 52/639 X |

FOREIGN PATENT DOCUMENTS

| | | | |
|---|---|---|---|
| 1,028,902 | 5/1966 | United Kingdom | 52/693 |

*Primary Examiner*—Leslie Braun

*Attorney, Agent, or Firm*—James R. Cypher

[57] ABSTRACT

A truss structure having upper and lower wood chords joined by tubular metal web members. The chords are formed with a plurality of slots for receiving the ends of the web members. Each slot extends from the inner face to the outer face of the chord. Cross bores extend from the inner walls of the slots laterally toward the edges of the chords. Clevis assemblies are inserted into each slot. The ends of the web members are inserted into the slots and attached to the clevis members by metal pins. Load forces from the webs are distributed to the faces of the wood chords through flanges on the clevis member or connector plates. Load forces are also distributed to the wood chords through the clevis member to the pin and directly to the wood by the configuration of the clevis member.

10 Claims, 21 Drawing Figures

TRUSS STRUCTURE WITH CLEVIS ASSEMBLY JOINTS

BACKGROUND OF THE INVENTION

Composite warren trusses characterized by wood chords and tubular web members have come into wide usage in the western states. The most popular light composite trusses are described in Troutner U.S. Pat. No. 3,137,899 granted June 23, 1964 and Gilb U.S. Pat. No. 3,857,218.

While commercially successful, the Troutner truss embodied in Pat. No. 3,137,899 was limited in the loads it could carry. The limiting factor was the pin joint since high web loads on the metal pin split the wood chord at the pin cross bores.

The Gilb truss U.S. Pat. No. 3,857,218 solved the chord splitting problem and was instantly successful because it raised the load value of the joint substantially.

Because of the Gilb metal edge pin connector, the wood chord was no longer the limiting factor since high test loads caused the webs to fail in the flattened end portions. Further increases in joint values were dependent upon a breakthrough in the web design and a type of metal connector assembly capable of accepting still higher web loads.

Troutner's attempts to raise joint values in trusses with mechanical devices such as his case connected web member Troutner U.S. Pat. No. 3,537,224 were commercially unsuccessful and he has apparently abandoned the metal connector for his recent developments have been in the "re-manufactured wood" field.

Gilb, on the other hand, continued the development of composite trusses using sawn lumber and metal connectors but his efforts shifted to medium and heavy trusses using double lumber members as shown in Gilb, U.S. Pat. No. 3,946,532 granted Mar. 30, 1976. Gilb's efforts to increase design loads in light duty, single sawn lumber chords were unsuccessful until the development of the "Clevis" principle as it is embodied in this application.

SUMMARY OF THE INVENTION

The gist of the present invention is the use of a clevis member which is inserted into a slot in the chord. Preferably the openings in the legs of the clevis are formed with drawn openings. In order to insert the clevis into the slot, the arms are pinched together to enable the drawn openings to fit into the slot. The drawn openings are then pressed into the faces of the slot opening adjacent the cross bores which hold the metal pin. The outside flanges of the clevis member are partially bent in order to insert the clevis member down through the slot in the chord. After insertion, the outside flanges are pressed at right angles into engagement with the outside face of the chord.

The major objectives achieved by the clevis assembly are as follows:

1. Truss designers may achieve higher joint values by using webs with greater cross sectional end areas instead of the standard flattened end webs which failed by buckling under web loads.
2. Truss designers may achieve higher joint values by using a clevis member which transfers web loads to the wood chords through flanges attached to the outer surface faces of the chords rather than by direct transference from the pin to a cross bore in the interior portion of the wood chord.

3. Fabricators may cut the chord slots completely through the chord from inside face to outside face eliminating the need to stop the slot short of the outside face to preserve needed chord cross section for axial tension stresses in composite trusses such as Troutner U.S. Pat. No. 3,137,899.
4. Reduction of truss fabrication costs.
5. The present truss provides a joint connection located at the center of the chords for those designers who specify such a connection.
6. Reduction of weight and costs of parts for the truss joint assembly over Gilb truss U.S. Pat. No. 3,857,218.
7. Reduction of capital equipment costs for truss fabrication over Gilb truss U.S. Pat. No. 3,857,218.
8. Fabricators need not bore the cross bore for the pin completely from edge to edge as required by Troutner U.S. Pat. No. 3,137,899.
9. Fabricators have a choice of using a clevis member with integral flanges formed in a single part, or the assembly may be made from two separate parts.

DESCRIPTION OF THE PREFERRED EMBODIMENTS OF THE INVENTION

Figure 1:
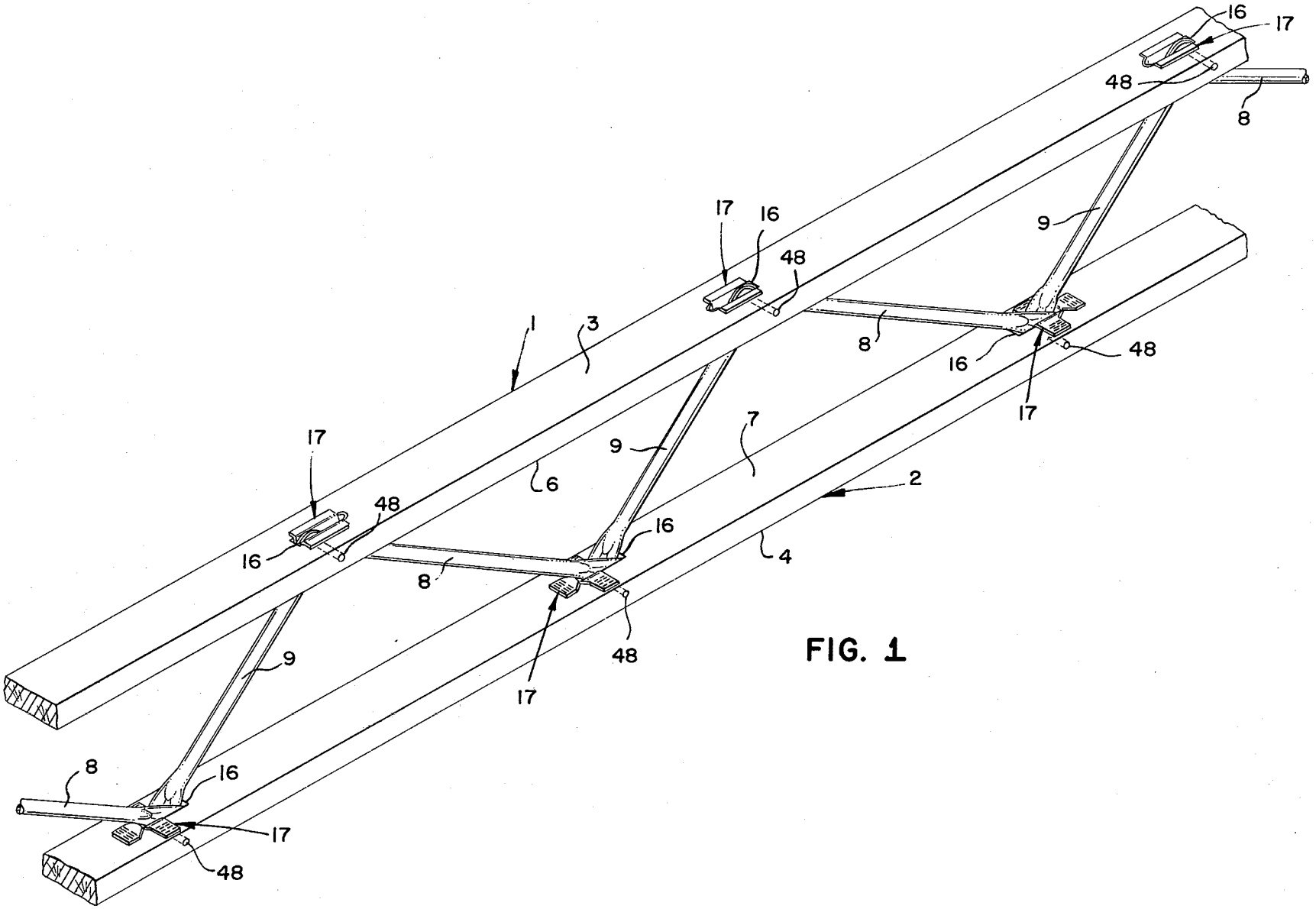
FIG. 1 is a perspective view of a composite warren truss having clevis assembly joints as described in the present invention.
Figure 3:
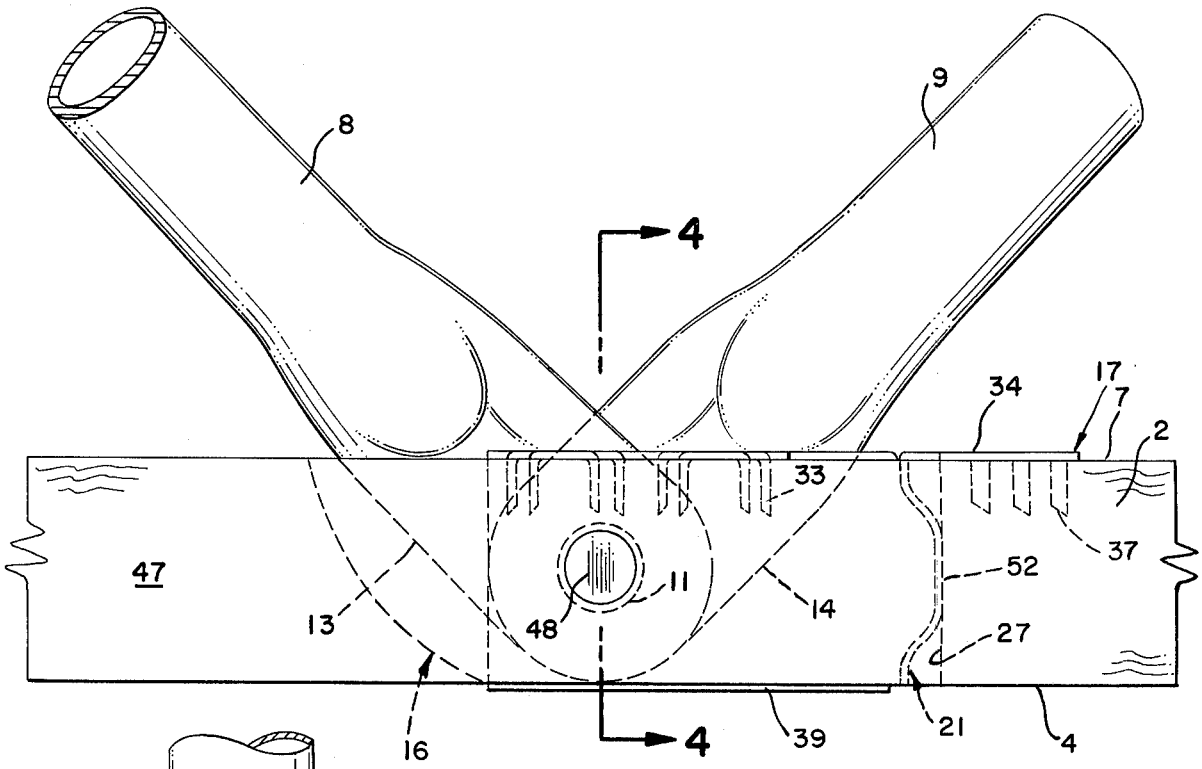
FIG. 3 is an enlarged side view of the truss joint of FIG. 2.

The truss of the present invention consists briefly of an upper wood chord 1, a lower wood chord 2, with each chord having an outer face 3 and 4 and an inner face 6 and 7. A plurality of tubular metal web members 8 and 9 having openings 11 and 12 formed in their ends 13 and 14 extend between the chords. The joint connection between the chords and webs has the following preferred construction.

The upper and lower chords are formed with a plurality of slots 16 spaced along the length of the chord and extend through the chords from the inner to the outer face.

A plurality of clevis members 17 are formed with first and second leg members 18 and 19 integrally joined at one end by an end portion 21 leaving the distal ends 22 and 23 free for lateral movement.

The clevis leg members are formed with aligned openings 24 and 25.

The clevis end portions are adapted for close fitting abutment with the ends 27 of the slots.

The clevis members are formed with inside face flanges 28 and 29 integrally connected at right angles to the inner edges 31 and 32 of the legs and are adapted for engagement with the inner faces of the chords.

Means 33 are provided for attaching the inside face flanges to the inner faces of the chords. Preferably, the means consists of a plurality of integrally formed prongs.

The clevis members are formed with an end flange 34 integrally connected to the inner edge 36 and at right angles to the end portion 21 and are adapted for engagement with the inner faces of the chords.

Means 37 for connecting the end flanges to the chords are provided and preferably consist of integrally formed prongs. The clevis members are formed with outside face flanges 38 and 39 integrally connected at right angles to the legs and are adapted for engaging the outer faces of the chords.

The chords are formed with cross bores 41 and 42 extending from the inner faces 43 and 44 of the slots outwardly toward the chord edges 46 and 47, and an elongated pin member 48 dimensioned for extending through the opening 11 and 12 in the web members through the openings 24 and 25 of the clevis members and extend into the cross bores 41 and 42 in the chords.

In the preferred form of the invention, openings 24 and 25 in the clevis leg members 18 and 19 are surrounded by integrally formed drawn sidewalls 49 and 50 which extend into the chords at the inner faces 43 and 44 of the slots.

The clevis member is preferably made from a single sheet of metal. A difficult problem was presented in bending the end portion 21 of the clevis member in a curve and then bending the end flange at a 90° angle. Forming this unusual configuration was accomplished by forming the end portion 36 of the clevis member with an embossment 52 extending the metal axially and outwardly from the clevis member thereby enabling the clevis end flange 34 to extend at right angles to the end portion along bend line 36.

A major feature of the present invention is the fact that the slot may be wide enough to accept the ends of tubular members which are reduced in cross section but the inner walls 53 and 54 and 55 and 56 are spaced from one another to increase the cross sectional area instead of being crushed flat as in standard webs. Further, the ends of the webs 13 and 14 are dimensioned so that a pair of web ends fills the slot area and holds the clevis leg members against the walls of the slots in the chords.

The load value of the joint may be increased by extending cross bores 41 and 42 in the chords from edge face 46 to edge face 47 of the chords.

Another form of the invention is shown in FIGS. 9 – 21. Basically, in this form of the invention, the clevis assembly is formed in two distinct parts which cooperate to achieve results similar to the form of the invention described above.

Figure 9:
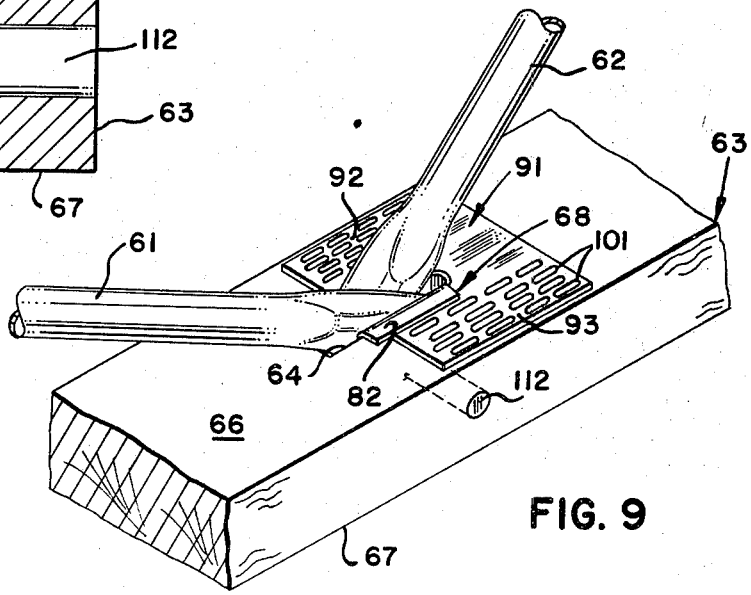
FIG. 9 is a perspective view of another form of the clevis assembly truss joint.
Figure 13:
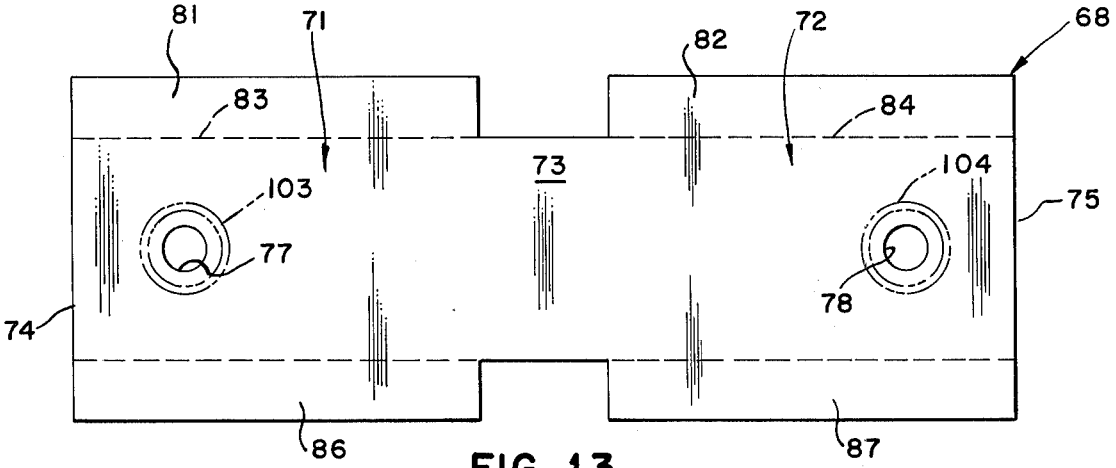
FIG. 13 is a plan view of the clevis member shown in FIG. 12 prior to forming.
Figure 15:
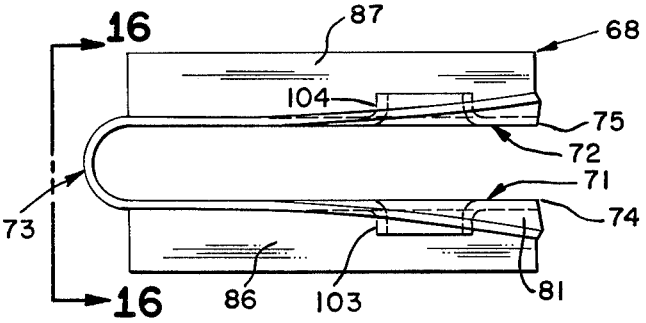
FIG. 15 is a top plan view of the clevis member shown in FIG. 12.
Figure 16:
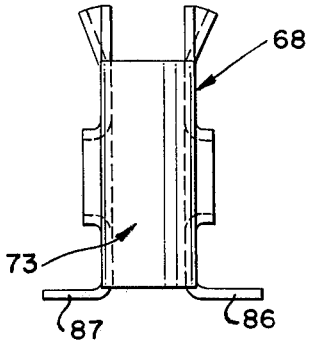
FIG. 16 is an end view of the clevis member shown in FIG. 12. The inner flanges are shown in a pre-bent position for purposes of assembly.
Figure 14:
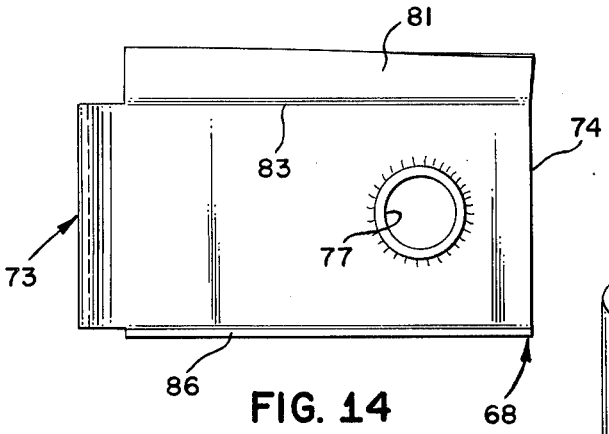
FIG. 14 is a side view of the clevis member shown in FIG. 12.
Figure 12:
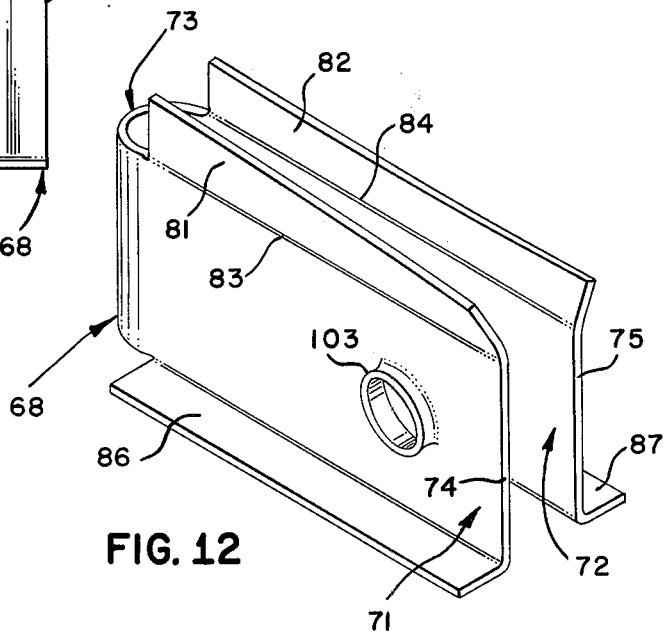
FIG. 12 is an enlarged perspective view of the clevis member shown in the previous FIGS. 9 - 11.
Figure 17:
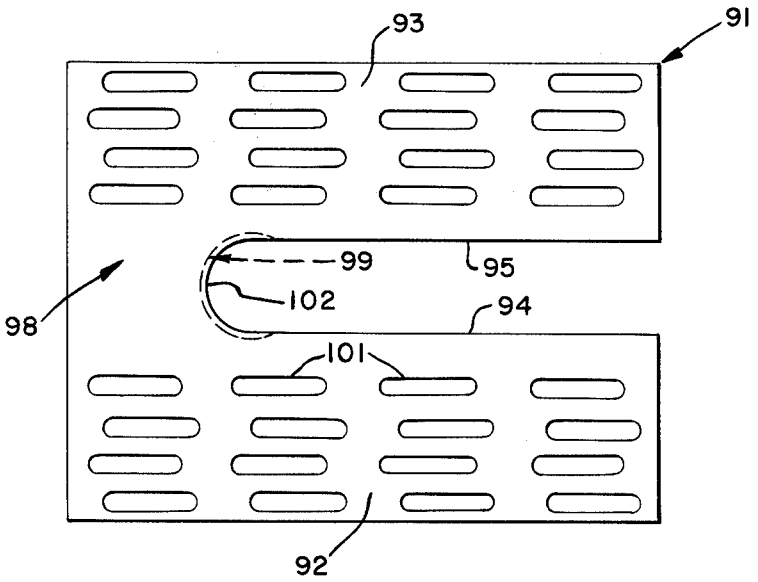
FIG. 17 is a top plan view of the inner plate of the clevis shown in FIG. 9.
Figure 19:
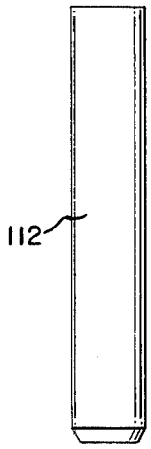
FIG. 19 is a plan view of the pin used in the assembly of FIG. 9.
Figure 18:
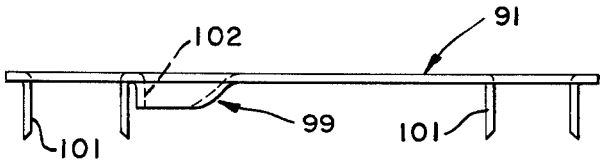
FIG. 18 is a side view of the inner plate shown in FIG. 17.

The assemblies are identical for the upper and lower chords of a truss and the orientation is similar to that shown in FIG. 1. FIG. 9 shows an assembly which is typical. The tubular web members 61 and 62 are the same as in the previously described truss.

Briefly, the upper chord (not shown) and lower chord 63 are formed with a plurality of slots 64 spaced along the length thereof and extend through the chords from the inner face 66 to the outer face 67. A plurality of clevis members 68 are formed with first and second leg members 71 and 72 integrally joined at one end by an end portion 73 leaving the distal ends 74 and 75 free for lateral movement. The clevis leg members are formed with aligned openings 77 and 78. The clevis end portions are adapted for close fitting abutment with the ends 79 of the slots. The clevis members are formed with inside face flanges 81 and 82 integrally connected at right angles to the inner edges 83 and 84 of the legs. The clevis members are formed with outside face flanges 86 and 87 integrally connected at right angles to the legs and adapted for engaging the outer faces 67 of the chords.

The inner plate members 91 are adapted for attachment to the inside faces 66 of the chords and have arms 92 and 93 having edges 94 and 95 bordering a substantial portion of each side 96 and 97 of the slot and have cross portions 98 bordering one end 79 of the slots. An outwardly drawn tongue 99 depends into the end of the slot.

The means for attaching the inner plate members may be nails but preferably the means consists of a plurality of prongs 101 integrally formed in the plate.

The end portion 73 of the clevis is positioned to engage the end 102 of the inner plate tongue and the inner face flanges of the clevis are positioned in engagement with the top face of the top plate member.

To increase the load value of the joint, openings 77 and 78 in the clevis leg members are surrounded by integrally formed drawn sidewalls 103 and 104 which extend into the chords at the inner faces 96 and 97 of the slots.

As set forth in the embodiment described above, the ends 106 and 107 of the tubular web members 61 and 62 are reduced in cross section so that the inner walls 108 and 109 and 110 and 111 are spaced from one another to increase the cross sectional area and the ends of the webs are dimensioned so that a pair of web ends fills the slot area and holds the clevis leg members against the walls 96 and 97 of the slots in the chords.

Figure 4:
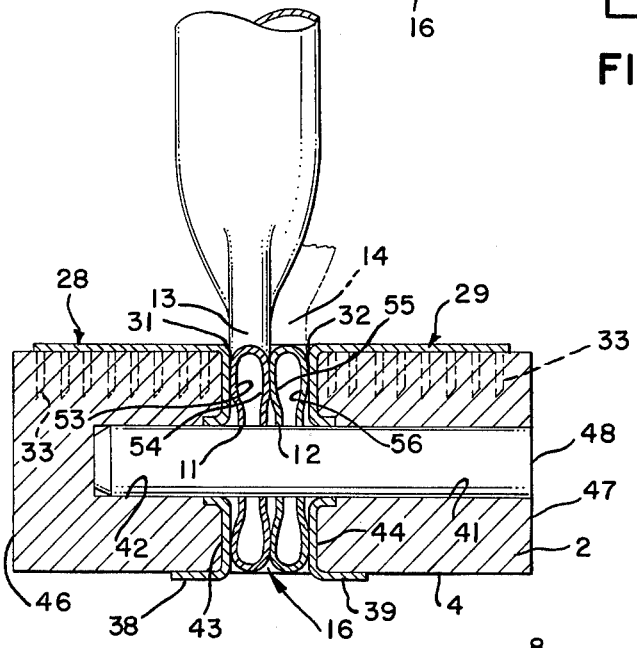
FIG. 4 is a cross section taken along line 4—4 of FIG. 3.
Figure 2:
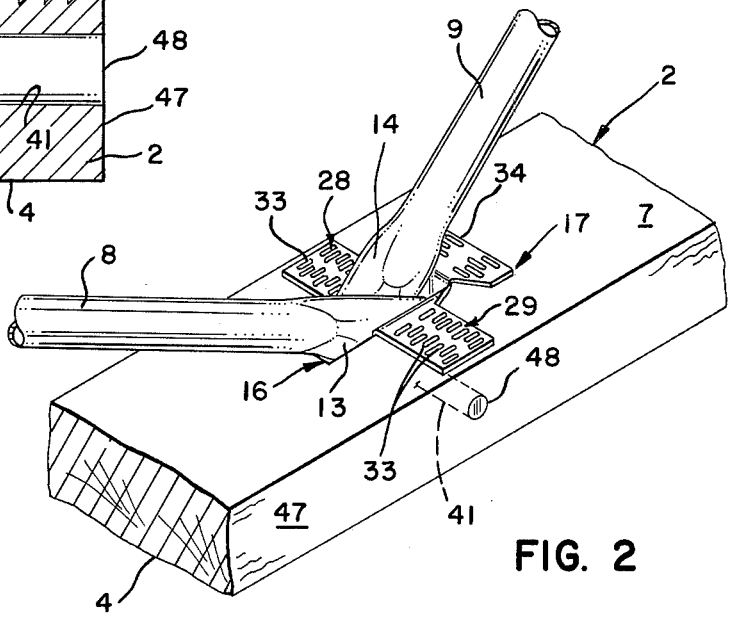
FIG. 2 is a single joint of the truss shown in FIG. 1 on a greatly enlarged scale.
Figure 5:
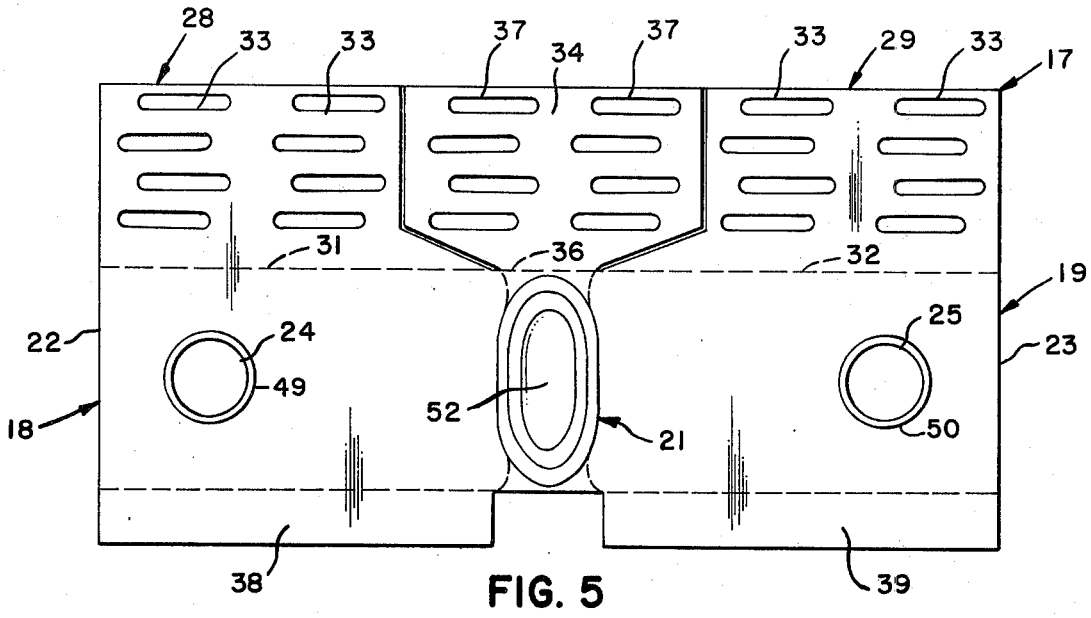
FIG. 5 is a plan view of the one-piece clevis member prior to forming.
Figure 6:
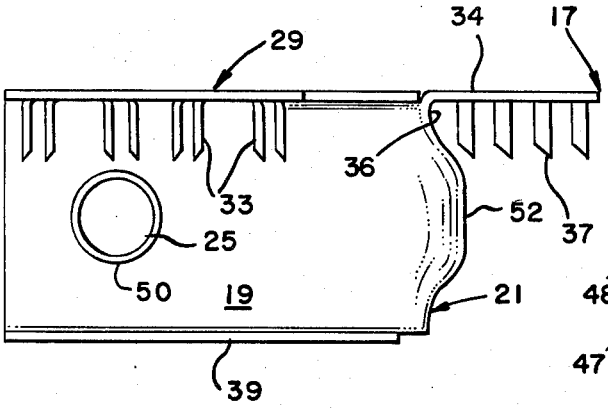
FIG. 6 is a side view of the clevis member of FIG. 5 after forming.
Figure 7:
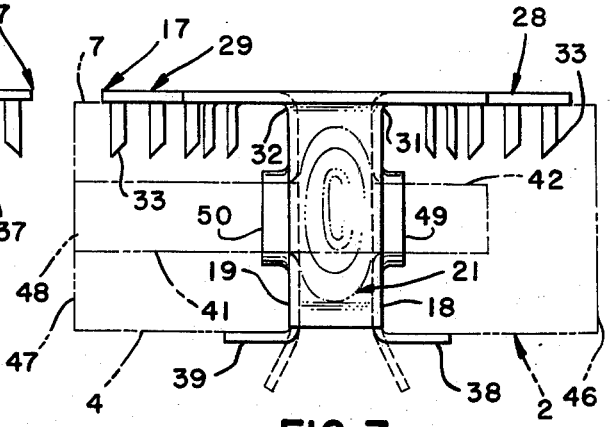
FIG. 7 is an end view of the clevis member of FIG. 5 after forming. A 2 × 4 chord member and metal pin are shown in phantom line. The dashed lines show the outer flanges in a partially bent position prior to installation within the chord slot.
Figure 8:
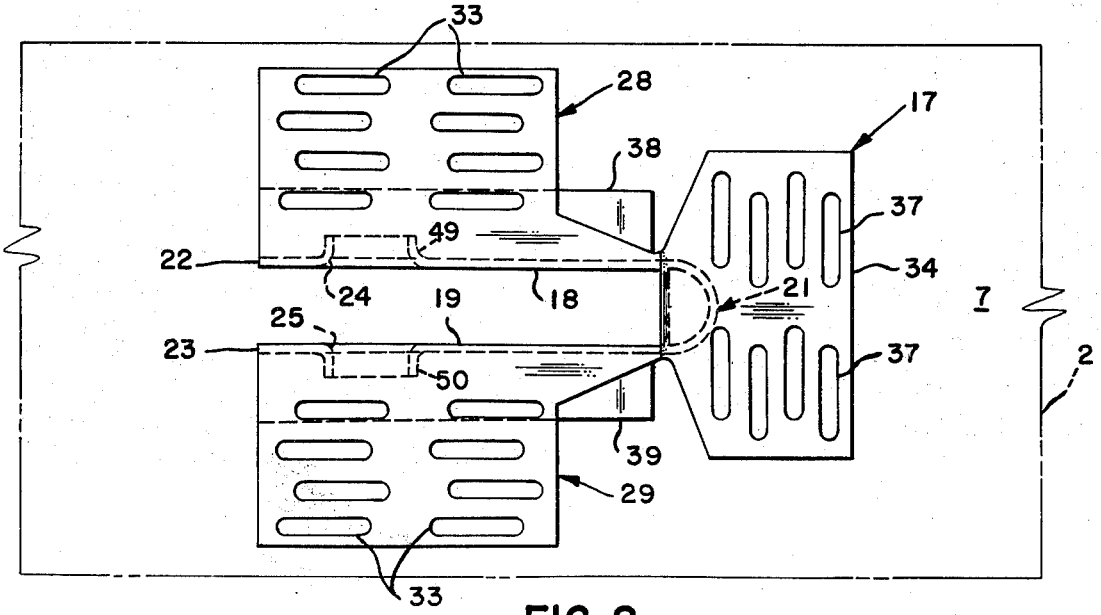
FIG. 8 is a top plan view of the clevis member after installation on a chord. The 2 × 4 chord is shown in phantom line.
Figure 10:
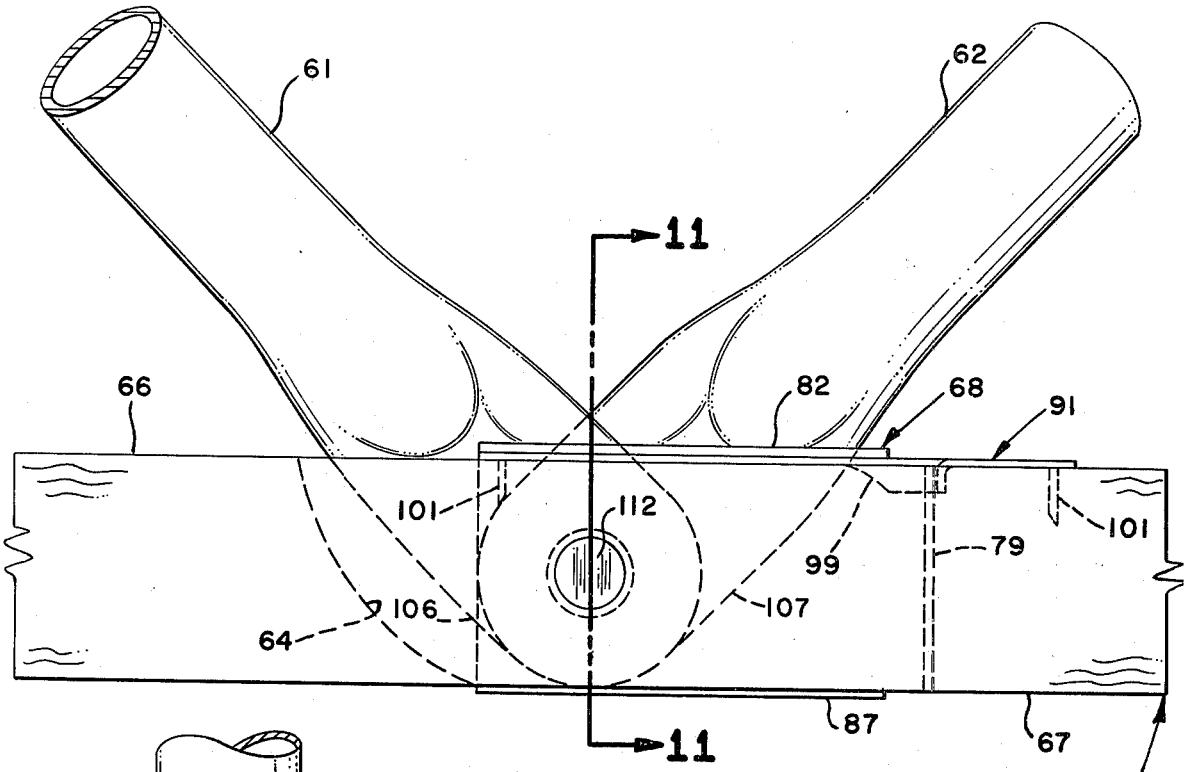
FIG. 10 is an enlarged side view of the truss-joint shown in FIG. 9.
Figure 11:
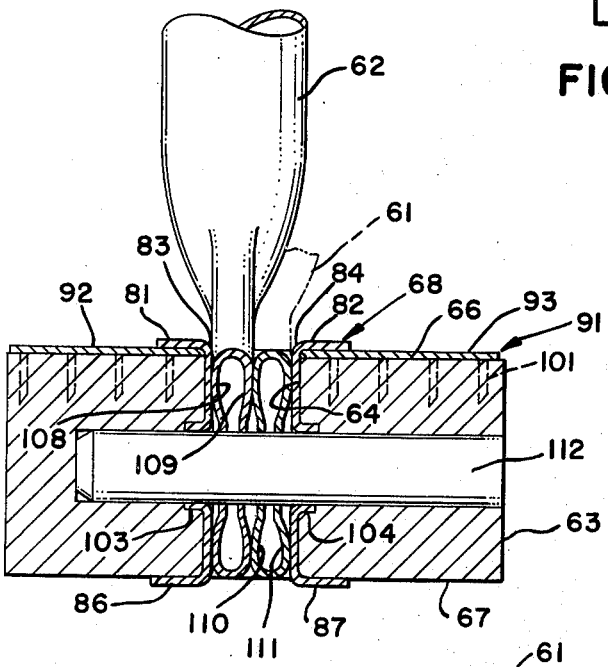
FIG. 11 is a cross sectional view of the truss joint of FIG. 10 taken along line 11—11.
Figure 20:
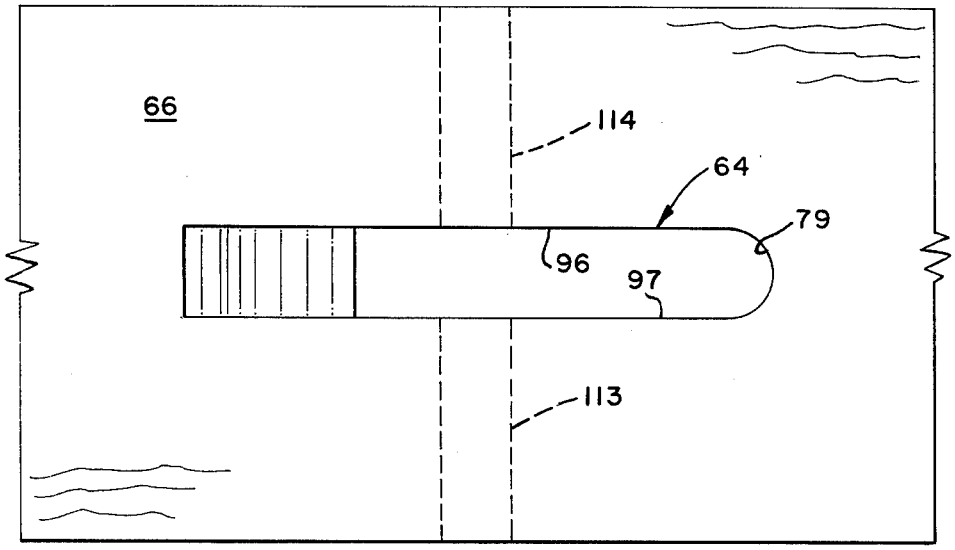
FIG. 20 is a plan view of the inner face of the chord showin the slot and pin arrangement of an alternate form of the invention.
Figure 21:
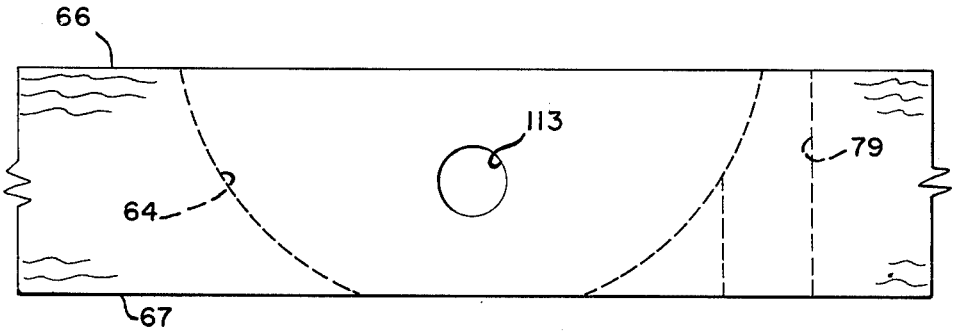
FIG. 21 is a side view of the portion of the chord shown in FIG. 20.

An elongated pin member 112 dimensioned for extending through said openings in said web members passes through the openings in the legs of the clevis members and extends into the cross bores 113 and 114 in the chords. The cross bore 114 and pin may extend partially through the chord as shown in FIG. 4 or entirely through from edge to edge as shown in FIG. 20 in either the form of the invention shown in FIG. 2 - 8 or FIGS. 9 - 15.

A specific example of the present invention is as follows.

In general, in this truss system, single 2 × 4 chords with a warren web configuration is used. The joint force transfer is essentially unilateral. The hair pin or clevis-like general configuration, wherein the head of the clevis is restrained perpendicular to the grain at the end of a slot is far more effective than the "case" solution of Troutner U.S. Pat. No. 3,537,224. Note that the Troutner "case" is not collapsible for purposes of inserting the device into the slot in the chord. Therefore the Troutner "case" is highly restricted as to features of secondary positioning restraint and the nature of the bearing pin. As a practical matter, the Troutner "case" must be preassembled to webs before inserting it into the slot. On the other hand, the clevis solution of the present invention permits the incorporation of drawn holes for better pin bearing, as well as a unique system of starter bends, both of which can be inserted in a slot of the same final dimension as the clevis because a clevis type device can be collapsed for purposes of insert into the slot.

Securing and final positioning becomes practical with the clevis because, once inserted, a straight pressure plate flattens the partially pre-bent retainers, while concurrently an insert on the same flat pressure plate, sized to the final inside diameter of the clevis, presses the drawn hole material into the side wood of the slot.

This application also solves the pin insertion problem. Any pin solution requiring placement before a clevis or case is inserted requires web assembly prior to such insertion and therefore is highly impractical. The pin for the clevis requires that a pin coming from one side go through the drawn hole of the clevis far enough into the other side to provide bearing. An advantage of the present system is that the pin does not necessarily have to go through the entire width of the chord and thus unnecessarily delete wood section in tension.

While the pin contributes somewhat to the value of the device, it is only significant for use as the means for providing the one-third code required negative and reverse loading provision. For all practical purposes, if it were not for this reason, a relatively very short pin could be inserted in the prepared hole to the point where the two ends were bearing on the drawn hole sidewalls of the clevis, with the unused portion of the hole either left as is or possibly plugged with a dowell. The clevis itself carries the primary loads in all directions except negative along the axis of the chord.

The prong plate element may be constructed in various ways. At present, it is a variation of an existing 3 × 6 special TrusWall Model No. 20 prong plate. In the present invention, it is a new special 3 × 4 in. plate as shown in the drawings. The plate is devised with a ⅝ in. slot and a drawn hole end to further reinforce the resistance of the clevis to imposed load as well as to provide reinforcement across the grain of the wood which would otherwise have a tendency to split as the failure mode if the loads were imposed entirely by the round portion of the clevis. Thus the prong plate element on the inside face of the chord provides two functions; namely, resistance to axial loads and prevents splitting of the chord due to the pressure of the end 73 of the clevis against the end wall 79 of the slot.

The pin has been somewhat arbitrarily sized as 2 ¾ inches long, without head but with tapered entry, and is intended to be driven into the assembly in an undersized hole, thus avoiding retainers and the like. Removal, for any reason, such as replacing bent webs, requires only a small hole to be drilled opposite its position location and a punch inserted into such a drilled hole to drive the pin back out of assembly.

The clevis itself has been engineered to perform not less than a 4,000 lb. I.C.B.O. rated value parallel to the chord in the direction of primary force transfer. A 14 gauge clevis without drawn hole is equal to this specified 16 gauge clevis with drawn holes by test. Values perpendicular to the chord are as provided by the tension arms, and to some extent by the pin and in either direction are engineered to provide not less than twice the values allowable to the joint in the Troutner truss set forth in U.S. Pat. No. 3,137,899.

The total weight of this assembly, that is the clevis, pin and prong plate is approximately 15% less than the total weight of the composite joint of Simpson U.S. Pat. No. 3,857,218 and represents much simpler fabrication and installation solutions. In the clevis joint expressed in a single piece clevis, it is not intended to develop the 4,000 lbs. plus rating of the two piece clevis joint. Instead, it is designed for the 3,000 lbs. minimum to perhaps 3,500 lbs. maximum potential as to be determined by tests. This value, however, is sufficient for at least 80% of all joints and in some cases, is sufficient for all joints in a typical warren type single chord truss.

The single clevis joint assembly is based upon the use of a special 3 × 6 TrusWall 18 gauge prong plate, with a particular prong pattern derived from their standard prong design.

The principle of using the clevis as a means of creating the possibility of insert and placement, including the partially bent opposite retainers, is incorporated in this model. The combined function of a "tail element" which provides both directional resistance and split resistance has been worked out as shown. In addition, the special problem created by it, namely, providing a means of straight line bend adjacent to and part of a necessarily curved surface has been worked out by the use of a tab draw boss as shown.

Referring to the two piece clevis assembly, the clevis insert blank is made from 16 gauge galvanized metal and is basically 6.375 ins. long and 2.25 ins. wide. The holes are 5/16 in. in diameter. They are drawn to 0.50 diameter. When formed, the clevis member end has a 0.25 in. radius.

The inside plate may be 4 ins. long and 3 ins. wide with a ⅝ in. slot. The drawn opening at the end of the slot has a depth of about 3/16 in. The pin used is one-half in. by 2.75 ins. long.

The webs are astma-570 and are made from 14, 16, or 19 gauge. The ends are formed with a half inch diameter opening and the ends have a 1 ½ in. width. The ends are reduced in cross sections so that they have a width of one-fourth in.

I claim:

1. A truss having upper and lower wood chords, each chord having outer and inner faces, and a plurality of tubular metal web members having openings formed in their ends extending between said chords, the joint connection between said chords and webs comprising:

a. said upper and lower chords are formed with a plurality of slots spaced along the length thereof and extending through said chords from said inner to said outer faces;

b. 2 plurality of clevis members formed with first and second leg members integrally joined at one end by an end portion, and said leg members have distal ends which are not attached to each other and are therefore free for lateral movement;

c. said clevis leg members are formed with aligned openings;

d. said clevis end portions are adapted for close fitting abutment with the ends of said slots;

e. said clevis members are formed with inside face flanges integrally connected at right angles to the inner edges of said legs and adapted for engagement with the inner faces of said chords;

f. means for attaching said inside face flanges to said inner faces of said chords;

g. said clevis members are formed with an end flange integrally connected to the inner edge and at right angles to said end portion and are adapted for engagement with the inner faces of said chords;

h. means for connecting said end flanges to said chords;

i. said clevis members are formed with outside face flanges integrally connected at right angles to said legs and adapted for engaging the outer faces of said chords;

j. said chords are formed with cross bores extending from the inner faces of said slots outwardly toward said chord edges; and k. an elongated pin member dimensioned for extending through said openings in said web members through said openings in said legs of said clevis members and extending into said cross bores in said chords.

2. A truss as described in claim 1 comprising:

a. said means for attaching said inside face flanges to said chords includes a plurality of integrally formed prongs; and b. said means for connecting said end flanges to said chords includes a plurality of integrally formed prongs.

3. A truss as described in claim 1 comprising:

a. said openings in said clevis leg members are surrounded by integrally formed drawn sidewalls extending into said chords at said inner faces of said slots.

4. A truss as described in claim 1 comprising:

a. said end portions of said clevis members are formed with embossments extending axially and outwardly from said clevis member for enabling said clevis end flange to extend at right angles to said end portion.

5. A truss as described in claim 1 comprising:

a. said ends of said tubular web members are reduced in cross section so that the inner walls are spaced from one another to increase the cross sectional area; and b. said ends of said webs are dimensioned so that a pair of web ends fills the slot area and holds said clevis leg members against the walls of the slots in said chords.

6. A truss as described in claim 1 comprising:

a said cross bores in said chords extend from edge face to edge face.

7. A truss having upper and lower chords, each chord having outer and inner faces and outer edge faces and a plurality of tubular metal web members having openings formed in their ends extending between said chords, the joint connection between said chords and webs comprising:

a. said upper and lower chords are formed with a plurality of slots spaced along the length thereof and extending through said chords from said inner to said outer faces; and a plurality of cross bores transverse to said chords and communicating with said slots and at least one edge face of said chords;

b. a plurality of clevis members formed with first and second leg members integrally joined at one end by an end portion, and said leg members have distal ends which are not attached to each other and are therefore free for lateral movement;

c. said clevis leg members are formed with aligned openings;

d. said clevis end portions are adapted for close fitting abutment with the ends of said slots;

e. said clevis members are formed with inside face flanges integrally connected at right angles to the inner edges of said legs;

f. said clevis members are formed with outside face flanges integrally connected at right angles to said legs and adapted for engaging the outer faces of said chords;

g. inner plate members adapted for attachment to the inside faces of said chords and having arms bordering a substantial portion of each side of said slot and having cross portions bordering one end of said slots and having an outwardly drawn tongue depending into the end of said slot;

h. said end portion of said clevis is positioned to engage said inner plate tongue;

i. said inner face flanges of said clevis are positioned in engagement with the top face of said top plate member; and j. an elongated pin member dimensioned for extending through said openings in said web members, through said openings in said legs of said clevis members and extending into said cross bores in said chords.

8. A truss as described in claim 7 comprising:

a. said means for attaching said top plate members includes a plurality of integrally formed prongs.

9. A truss as described in claim 8 comprising:

a. said openings in said clevis leg members are surrounded by integrally formed drawn sidewalls extending into said chords at said inner faces of said slots.

10. A truss as described in claim 8 comprising:

a. said ends of said tubular web members are reduced in cross section so that the inner walls are spaced from one another to increase the cross sectional area; and b. said ends of said webs are dimensioned so that a pair of web ends fills the slot area and holds said clevis leg members against the walls of the slots in said chords.

* * * * *

UNITED STATES PATENT AND TRADEMARK OFFICE

CERTIFICATE OF CORRECTION

PATENT NO. : 4,069,635

DATED : January 24, 1978

INVENTOR(S) : TYRELL T. GILB

It is certified that error appears in the above-identified patent and that said Letters Patent are hereby corrected as shown below:

Column 3, line 2, change "showin" to --- showing ---

Column 7, line 5, change "2" to --- a ---

Signed and Sealed this

Sixteenth Day of May 1978

[SEAL]

Attest:

RUTH C. MASON
Attesting Officer

LUTRELLE F. PARKER
Acting Commissioner of Patents and Trademarks